US006035948A

United States Patent [19]

Griffin

[11] Patent Number: 6,035,948

[45] Date of Patent: Mar. 14, 2000

[54] APPARATUS FOR MOUNTING A HAND-HELD PAVEMENT BREAKER ON A BACKHOE BUCKET

[76] Inventor: Walter J. Griffin, 633 Eagle Ridge Rd., Lyons, Colo. 80540

[21] Appl. No.: 09/232,436

[22] Filed: Jan. 15, 1999

[51] Int. Cl.[7] ..... B25D 17/28; E02F 3/96

[52] U.S. Cl. ..... 173/184; 173/29; 173/46; 173/171; 37/403; 37/903

[58] Field of Search ..... 173/184, 24, 29, 173/44, 28, 46, 169, 171; 37/403, 404, 408, 903; 172/699, 701.1; 299/24, 37, 67

[56] References Cited

U.S. PATENT DOCUMENTS

| | | | |
|---|---|---|---|
| 3,596,996 | 8/1971 | Carter | 299/10 |
| 3,627,064 | 12/1971 | Sjoberg | 173/24 |
| 3,864,793 | 2/1975 | Guest | 24/243 CC |
| 3,922,745 | 12/1975 | Lehman | 15/87 |
| 3,997,068 | 12/1976 | Lock | 173/29 |
| 4,070,772 | 1/1978 | Motomura et al. | 173/46 |
| 4,087,010 | 5/1978 | Stormon | 214/145 R |
| 4,100,688 | 7/1978 | Grist | 37/117.5 |
| 4,360,980 | 11/1982 | Jarvis | 172/701.1 |
| 4,417,628 | 11/1983 | Gessner | 173/29 |
| 4,889,192 | 12/1989 | Ricard | 173/46 |
| 5,197,212 | 3/1993 | Vail | 37/903 |
| 5,234,282 | 8/1993 | Osborn | 404/90 |
| 5,423,137 | 6/1995 | Cochran | 37/408 |
| 5,456,028 | 10/1995 | Larson | 37/403 |
| 5,689,905 | 11/1997 | Ibusuki | 37/403 |
| 5,695,017 | 12/1997 | Gessner | 173/184 |

*Primary Examiner*—Scott A. Smith
*Attorney, Agent, or Firm*—Patent Law Offices of Rick Martin, P.C.

[57] ABSTRACT

A mount to attach a standard hand-held pavement breaker to a backhoe bucket quickly and easily. The invention allows the pavement breaker to be mounted and dismounted without a person having to lift or manually operate the pavement breaker. The mount attaches to the handles of the pavement breaker and then to the side of the backhoe bucket. The sleeves which fit over the handles are adapted to automatically depress the trigger of the pavement breaker whenever the pavement breaker is in firm contact with the surface to be broken.

4 Claims, 3 Drawing Sheets

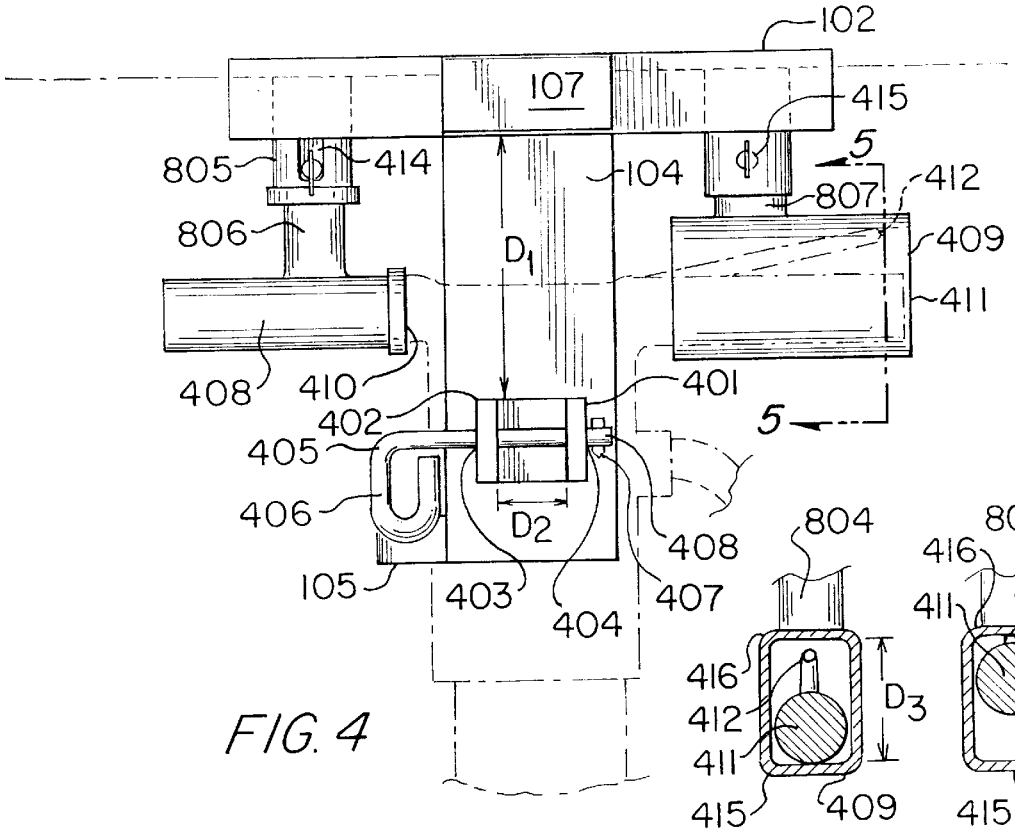
FIG. 4
FIG. 5
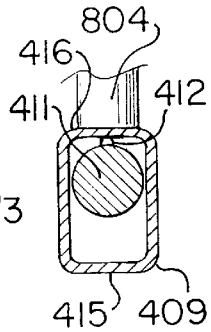
FIG. 6
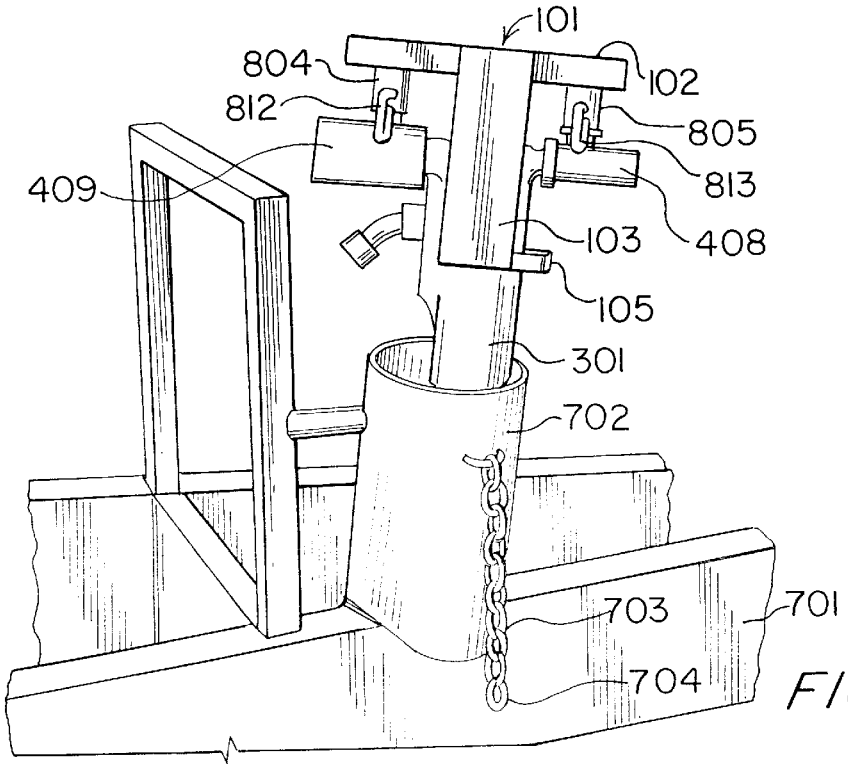
FIG. 7

APPARATUS FOR MOUNTING A HAND-HELD PAVEMENT BREAKER ON A BACKHOE BUCKET

FIELD OF INVENTION

The present invention relates to a device to allow a standard hand-held pavement breaker to be mounted on a backhoe bucket quickly and easily. The invention allows the pavement breaker to be mounted and dismounted without a person having to lift or manually operate the pavement breaker.

BACKGROUND OF THE INVENTION

A hand-held pavement breaker is a frequently used device in construction. A pavement breaker, also known as a jack hammer, can weigh between 60 and 90 pounds. The operator is required to lift the pavement breaker each time it needs to be moved. The operator is also subjected to significant vibration and noise from the operation of the pavement breaker. Back injuries and repetitive motion injuries, such as carpal tunnel syndrome, are common among operators. Additionally, a pavement breaker by its nature throws up small particles which can get in the eyes, nose or mouth of the operator. Attempts have been made to solve these problems by attaching pavement breakers and similar devices to a backhoe. Some of the relevant patents are listed below.

U.S. Pat. No. 3,596,996 (1971) to Carter discloses a ground ripper mounted on the back of a back hoe bucket. The ripper is mounted with a pin lock system on the mounting holes of the bucket.

U.S. Pat. No. 3,627,064 (1971) to Sjoberg et al. discloses a wheeled mount for a jack hammer which is designed so that the operator does not have to hold the weight of the jack hammer or have the vibration transmit to the operator. The trigger of the jack hammer is depressed by the operator pressing a lever on the mount, which in turn depresses the trigger.

U.S. Pat. No. 3,864,793 (1973) to Guest discloses a device to allow different tools to be attached to a backhoe bucket.

U.S. Pat. No. 3,922,745 (1975) to Lehman discloses a rotating broom that is attached to a backhoe bucket.

U.S. Pat. No. 4,087,010 (1978) to Stormon discloses a backhoe mount for a jack hammer. The mount attaches to the back of the bucket at the mounting joints of the bucket. The trigger is automatically depressed by a spring lever above the handle when the jack hammer is pressed against the ground. The jack hammer is not easily visible by the operator when the jack hammer is being used directly in front of the backhoe.

U.S. Pat. No. 4,100,688 (1976) to Grist discloses a compacting roller mounted on the back of a hydraulic shovel.

U.S. Pat. No. 4,417,628 (1981) to Gessner discloses an earth borer which is mounted to the front of a backhoe bucket. The earth borer is mounted with a pin lock system to the front of the backhoe bucket.

U.S. Pat. No. 5,234,282 (1993) to Osborn discloses a gravity drop hammer mounted on a skid loader.

U.S. Pat. No. 5,423,137 (1995) to Cochran discloses a combination pavement cutting and excavating tool.

U.S. Pat. No. 5,689,905 (1997) to Ibusuki discloses a combination chisel and shovel arm.

All of the devices listed above that allow a pavement breaker or similar device to be attached a backhoe are not ideal for most applications. The devices are not easily or quickly attached to the backhoe. They require that the pavement breaker be lifted to be attached to the backhoe bucket. This is time consuming and hazardous.

Many of the devices attach the pavement breaker to the back of the bucket. This means that the pavement breaker is not in easy view of the operator of the backhoe. The operator must lean to one side or the other in order to see the actual point of contact with the ground. This is tiring for the operator and can cause back problems. A clear field of vision for the operator of the pavement breaker is also very important to prevent accidents.

Some of the above listed patents provide for attaching a pavement breaker or similar device to the front of the backhoe bucket. This means that the backhoe bucket cannot be used at all without dismounting the device. This is very time consuming and requires repeated lifting of the device.

SUMMARY OF THE INVENTION

The primary aspect of the present invention is to provide a mount for a pavement breaker that will allow it to be quickly and easily mounted on a backhoe bucket or most similar earth moving buckets.

Another aspect of the present invention is to provide a system whereby a pavement breaker can be mounted and dismounted from a backhoe bucket without the pavement breaker having to be lifted by the operator.

Another aspect of the present invention is to provide a method of mounting a pavement breaker on a backhoe bucket that provides for the automatic operation of the pavement breaker. When the breaker is in contact with a surface to be broken the breaker is automatically turned on and when the breaker is not in contact with the surface the breaker automatically shuts off.

Another aspect of the present invention is to provide a mount that is sturdy, with a minimum number of parts which can break or jam.

Another aspect of the present invention is to provide a mount which is easy and cheap to manufacture.

Another aspect of the present invention is to provide a mount for a pavement breaker that allows the breaker to be used on vertical surfaces, down in holes or other hazardous or difficult locations.

Another aspect of the present invention is to allow the bucket to continue to be usable for scraping away broken debris while the pavement breaker is still attached to the bucket.

Other aspects of this invention will appear from the following description and appended claims, reference being made to the accompanying drawings forming a part of this specification wherein like reference characters designate corresponding parts in the several views.

The present invention is a mount for a pavement breaker which has a frame with handle sleeves removably attached to allow the pavement breaker to be mounted on the side of a backhoe bucket by suspending the pavement breaker from the handles. This allows a trigger sleeve to be used to automatically turn on the pavement breaker when the pavement breaker is in contact with the surface to be broken. The handle sleeves allow the mount to be quickly and easily attached to the pavement breaker.

Attaching the pavement breaker on the side of the bucket allows the bucket to be used while the pavement breaker is still attached to the bucket. The bucket is commonly used to scrape away the broken debris from the pavement breaker. This also shows which parts need to be broken up more. Not having to dismount the pavement breaker in order to use the bucket allows work to proceed at a much faster pace.

BRIEF DESCRIPTION OF THE DRAWINGS

FIG. 4 is a back plan view of the preferred embodiment.

FIG. 5 is a cross section of the trigger sleeve through line 5—5 with the trigger in the off position.

FIG. 6 is a cross section of the trigger sleeve through line 5—5 with the trigger in the on position.

FIG. 7 is a plan view of the pavement breaker with mount in a holding bucket waiting to be picked up by the backhoe bucket.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
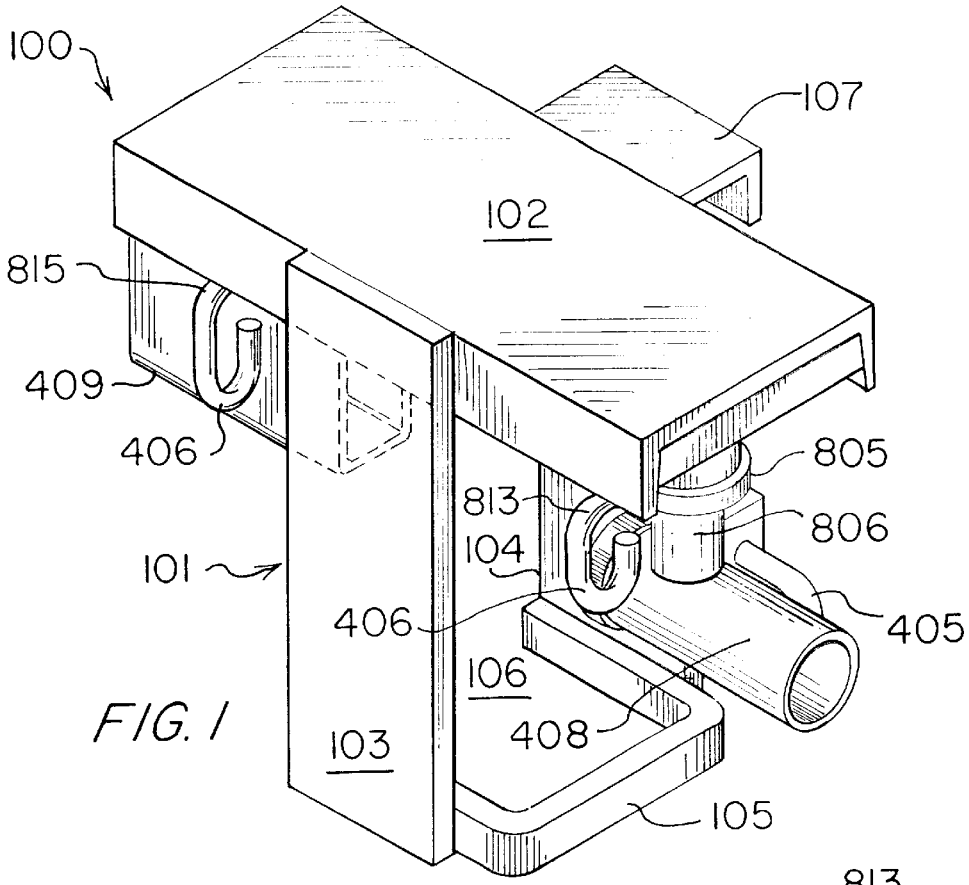
FIG. 1 is a front perspective view of the preferred embodiment of the pavement breaker mount.
Figure 3:
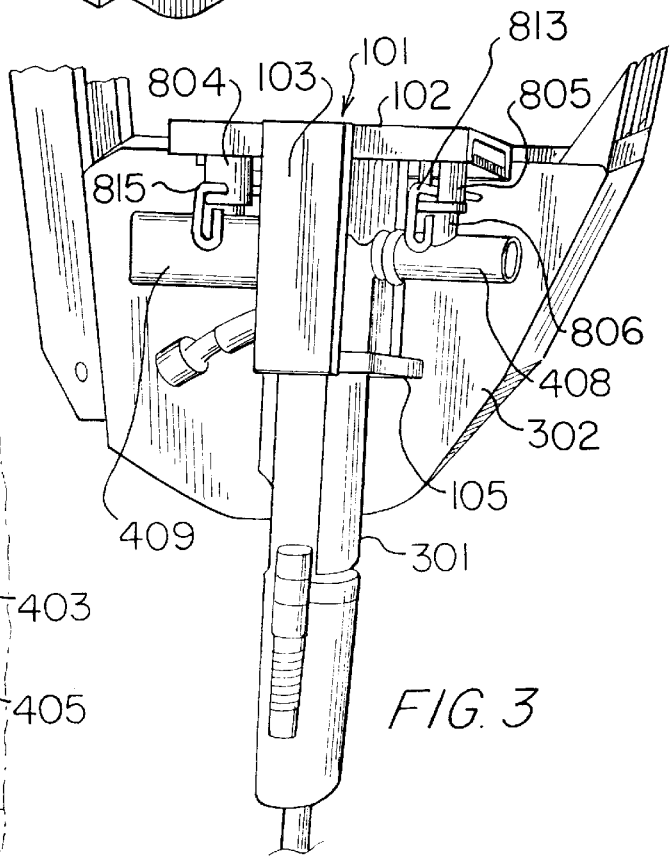
FIG. 3 is a perspective view of the preferred embodiment with a pavement breaker in the mount on a backhoe bucket.

Referring first to FIGS. 1 and 3 the assembled mount 100 is shown. The frame 101 is wide enough to fit over the pavement breaker 301. The top plate 102 has two side pieces 103, 104 attached to opposing sides. A side frame 105 is attached to each of the two side pieces 103, 104, leaving an open side 106 on the frame 101.

On one side of the frame 101 a hook 107 is attached over one of the side pieces 104. Directly below the hook 107 on the side piece 104 are two plates 401, 402 extending perpendicularly from side piece 104, as shown in FIG. 4. These plates 401, 402 are space $D_1$ down from the hook 107 and $D_2$ apart. The plates 401, 402 each have a hole 403, 404. These holes 403, 404 are aligned with each other such that a pin 405 can be placed through both holes 403, 404.

Figure 8:
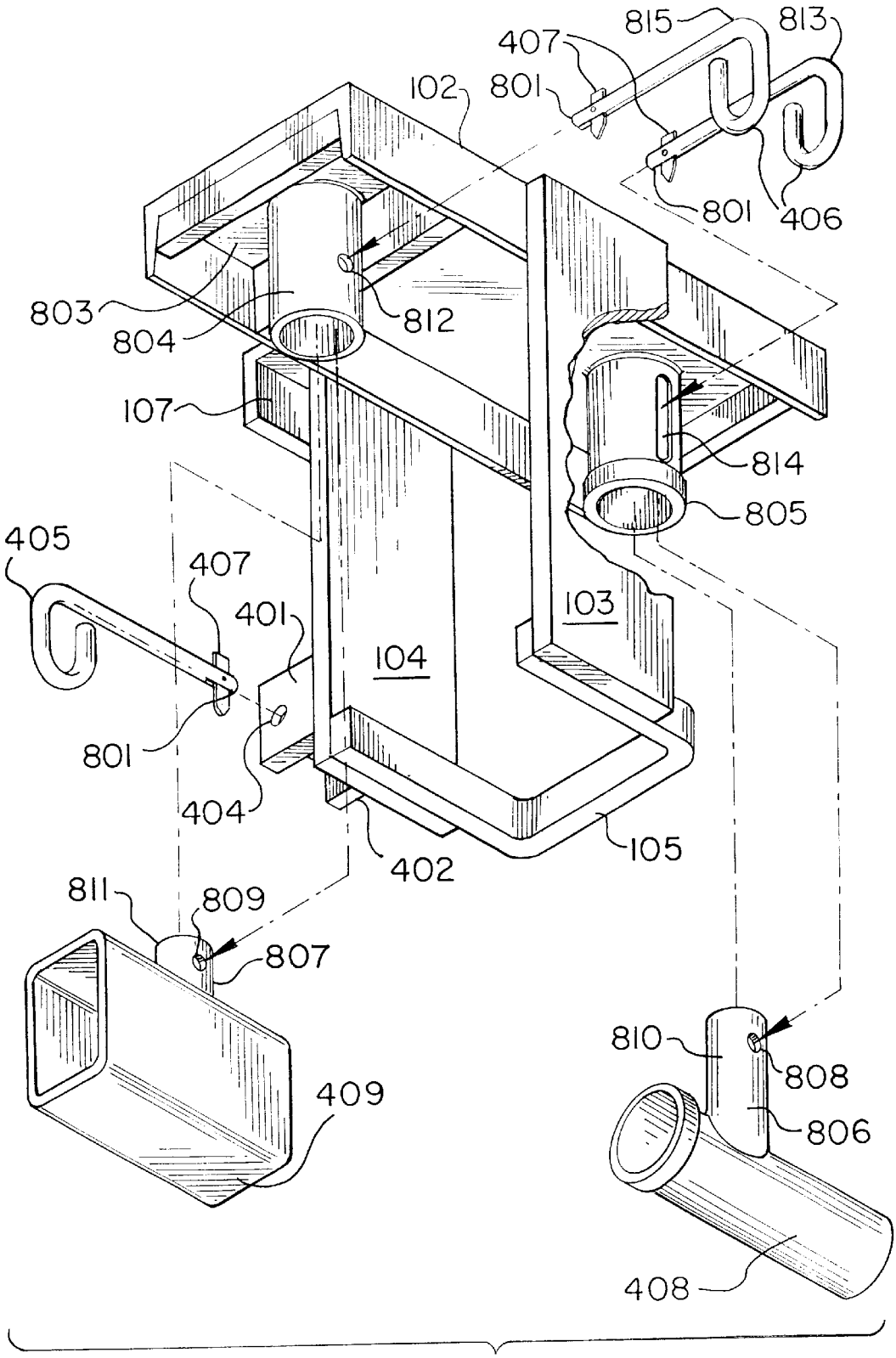
FIG. 8 is an exploded view of the preferred embodiment.

Pin 405 has a handle 406 on one end and a locking pin 407 on the insertion end 408. The locking pin 407 is in a slot 801 in the insertion end 408 and is held in place by pivot 802, as shown in FIG. 8. To insert the pin 405 through the holes 403, 404 the locking pin 407 is pivoted so that is parallel with the pin 405 (not shown). The locking pin 407 is naturally in the locked position as shown in FIG. 2.

Figure 2:
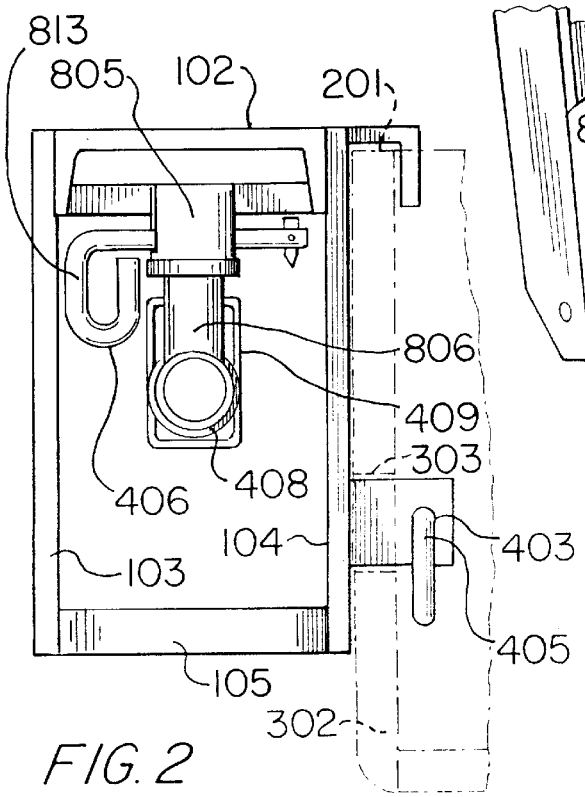
FIG. 2 is a side plan view of the preferred embodiment attached to the side of a backhoe bucket with the front of the bucket cut away.

A trigger sleeve 409 and a handle sleeve 408 each have posts 807 and 806, respectively, attached to the top surface, as shown in FIGS. 2 and 8. Each post 806, 807 has a hole 808, 809, respectively, which extends through the post 806, 807 on the opposing end, 810, 811 from the sleeves. The longitudinal axis of holes 808, 809 is perpendicular to the longitudinal axis of the sleeves.

Attached to the underside 803 of the top plate 102 are two hollow sleeve mounts 804, 805. These allow the trigger sleeve 409 and the handle sleeve 408 to be attached to the frame 101. Sleeve mount 804 is adapted to fit post 807 of the trigger sleeve 409 inside it. Holes 812 and 413 are on opposing sides of post 807 and are placed to line up with hole 809 in post 807 when post 807 is slid up into sleeve mount 804. Pin 815, which is identical to pin 405, can then be inserted through all three holes, 809, 812, and 413. Pin 815 locks in the identical manner as described above for pin 405.

The handle sleeve 409 attaches to the frame 101 in the identical manner with post 806 sliding into sleeve mount 805 which are then locked together with pin 813. Sleeve mount 805 has two vertical slots 814, 414 instead of holes. These slots 814, 414 allow the handle sleeve to move vertically when attached to the frame 101.

The pavement breaker 301 is shown in the mount 101 in FIGS. 3 and 4. The pavement breaker 301 has two handles 410 and 411. Handle 411 has a trigger 412. To place the mount 100 on pavement breaker 301 both sleeves 408, 409 are removed from the mount 100. The handle sleeve 408 is then slid over handle 410. Next, the trigger sleeve 409 is slid over handle 411 and the trigger 412. The trigger sleeve 409 has an internal height $D_3$ which is sufficient to allow the trigger sleeve 409 to slide over the handle 411 and trigger 412 without depressing the trigger.

Next, the frame 101 is then placed around the pavement breaker 301 with the top plate 102 above the handles 410, 411. Post 806 of the handle sleeve 408 is inserted into sleeve mount 805 and pin 813 is then inserted through vertical slots 814, 414 and hole 808 to lock the handle sleeve 408 in place.

Next, the post 807 of trigger sleeve 409 is inserted into sleeve mount 804 and pin 815 is inserted through holes 812, 809 and 413. The mount 101 is now attached to the pavement breaker 301.

To attach the mount 101 to a backhoe bucket 302 the hook 107 is placed over the top edge 201 of the backhoe bucket 302. Two slots 303 are cut in the backhoe bucket 302 to allow the plates 401, 402 to extend though the backhoe bucket 302, as shown in FIG. 2. The slots 303 are cut in the approximate center of the side of the backhoe bucket 302 and do not effect the structural integrity of the bucket 302. The mount 101 is locked in place by inserting pin 405 through holes 403, 404, as shown in FIG. 4. Alternatively, a bolt and nut or similar removable locking device (not shown) can be used in place of any the pins, 405, 813, and 815

In addition to a backhoe bucket 302, the present invention can be attached to any similar sized bucket on earth moving equipment. This provides a large amount of versatility for an operator.

The present invention is designed such that the mount 101 with the pavement breaker 301 can be mounted on the backhoe bucket 302 without the operator having to lift the 100 pound plus apparatus. The pavement breaker 301 is placed in a holder 702, as shown in FIG. 7. This holder 702 is generally attached to the trailer 701 for the backhoe, near were the bucket 302 rests. Once the pavement breaker is placed in the holder 702, it does not have to be lifted by a person again.

The mount 101 is then attached to the pavement breaker 301. The operator then simply starts the backhoe and operates the bucket 302 so that the top edge 201 of the bucket 302 comes up under the hook 107 and lifts the apparatus up out of the holder 702. If necessary, the operator can shake the bucket 302 to align the plates 401, 402 with the slots 303 in the side of the bucket 301. Alternatively, the operator can slide the mount 101 over by hand. Once the plates 401, 402 are through slots 303, pin 405 is inserted as described above.

To operate the pavement breaker 301 normally, the operator holds on to both handles, 410, 411 and then depresses trigger 412 with his hand. The present invention is designed to operate the pavement breaker 301 automatically when in the mount 101 and attached to the bucket 302. When the pavement breaker 301 is in the mount 101 on the bucket 302 the pavement breaker 301 is hanging from the handles 410, 411. The trigger sleeve 409, as mentioned above, has an internal height $D_3$ such that the trigger 412 is not depressed at all when the pavement breaker 301 is hanging from the bucket 302 and the handle 411 is resting on the bottom surface 415 of the trigger sleeve 409, as shown in FIG. 5.

When the operator lowers the bucket 302 so that the pavement breaker 301 comes into contact with the surface to be broken, the handle 411 of the pavement breaker 301 is pushed up against the top surface 416 of the trigger sleeve 409, depressing the trigger 412, as shown in FIG. 6. This automatically starts the pavement breaker 301 when ever it is in firm contact with a surface. As soon as the pavement breaker 301 is lifted, the handle 411 drops back down and the pavement breaker 301 shuts off. The sleeve mount 805 for the handle sleeve 408 has vertical slots 814, 414. These slots 814, 414 allow the handle sleeve 408 to move vertically as the pavement breaker 301 is pressed against a surface, keeping the pavement breaker 301 perpendicular to the surface.

To remove the apparatus from the bucket 302 the operator simply removes pin 405 and then uses the backhoe bucket 302 to place the apparatus back into the holder 702. The bucket 302 is then lowered, disengaging it from the hook 107 and plates 402, 402. For additional security when moving the trailer 701 chain 703 is attached to holder 702. Once the apparatus is in the holder 702 the free end 704 of chain 703 is lifted up to the plates 401, 402. Pin 405 is then inserted through hole 403, through one link of the chain 703 and then through hole 404, attaching the mount 101 to the holder 702.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A mount to attach a hand-held pavement breaker to the side of a backhoe bucket comprising;

a frame having a top plate, a top surface and underside, and two side pieces attached on either side of said top plate, a side frame extending between said side pieces on opposing ends from said top plate, two hollow sleeve mounts attached to said top plate, spaced a given distance apart, said hollow sleeve mounts each having an open end opposite the top plate, a handle sleeve adapted to fit over a handle of the pavement breaker, said handle sleeve having a post extending substantially perpendicularly from one end, a trigger sleeve adapted to fit over a second handle and trigger of the pavement breaker without depressing said trigger, said trigger sleeve having a post extending substantially perpendicularly from one end, said post of said handle sleeve being slidably engaged with the open end of one of said first hollow sleeve mounts and removably attached to said hollow sleeve mount, said post of said trigger sleeve being slidably engaged with the open end of said second hollow sleeve mount and removably attached to said hollow sleeve mount, a hook attached to said frame adapted to engage a top edge of said back hoe bucket, and said frame being removably attached to said bucket.

2. The mount of claim 1, further comprising;

two plates extending substantially perpendicularly from one side piece, said plates spaced a given distance apart and a second given distance from said hook, said plates each having a hole extending through said plates substantially parallel to said side piece, said plates be adapted to fit through two holes in the side of said backhoe bucket, a locking pin slidably engaged with said holes functioning to removably attach said mount to said backhoe bucket.

3. The mount of claim 2 further comprising;

two vertical slots on opposing sides of said first hollow sleeve mount, a hole extending through said post of said handle sleeve, the longitudinal axis of said hole being substantially perpendicular to the longitudinal axis of said handle sleeve, a locking pin slidably engaged with said vertical slots and said hole functioning to removably attach said handle sleeve to said first hollow sleeve mount.

4. The mount of claim 2 further comprising;

two holes on opposing sides of said second hollow sleeve mount, a third hole extending through said post of said trigger sleeve, the longitudinal axis of said hole being substantially perpendicular to the longitudinal axis of said trigger sleeve, a locking pin slidably engaged with said holes functioning to removably attach said trigger sleeve to said second hollow sleeve mount.

* * * * *